United States Patent [19]

Elbaz

[11] Patent Number: 4,729,275

[45] Date of Patent: Mar. 8, 1988

[54] PAD FITTING DEVICE FOR A WIND MUSICAL INSTRUMENT KEY

[76] Inventor: Aimé Elbaz, 50, Avenue Jean-Jaurés, 75019 Paris, France

[21] Appl. No.: 26,753

[22] Filed: Mar. 17, 1987

[30] Foreign Application Priority Data

Apr. 2, 1986 [FR] France ..... 86 04707

[51] Int. Cl.[4] ..... G10D 9/04

[52] U.S. Cl. ..... 84/385 P

[58] Field of Search ..... 84/385 P

[56] References Cited

U.S. PATENT DOCUMENTS

| | | | |
|---|---|---|---|
| 1,401,872 | 12/1921 | Buescher | 84/385 P |
| 1,702,962 | 2/1929 | Buescher | 84/380 |
| 1,728,553 | 9/1929 | Klingler | 84/385 P |
| 1,747,113 | 2/1930 | Gulick | 84/385 P |
| 3,205,752 | 9/1965 | Carruthers | 84/380 |
| 3,501,991 | 3/1970 | Carruthers et al. | 84/385 P |
| 3,688,633 | 9/1972 | Nagao | 84/385 P |

FOREIGN PATENT DOCUMENTS

| | | | |
|---|---|---|---|
| 2257973 | 8/1975 | France | 84/385 P |
| 717902 | 11/1954 | United Kingdom | 84/385 P |

*Primary Examiner*—Lawrence R. Franklin

*Attorney, Agent, or Firm*—Steele, Gould & Fried

[57] ABSTRACT

The invention provides a pad fitting device for a wind musical instrument key. In this device, the center of the pad (2) is connected to the center of the bottom of the cup (3) by a spherical hinge (5, 6) allowing a free universal angular movement of pad (2) without rotation, so that the pad may assume any slanted position with respect to the cup (3) so as to be applied freely and uniformly at all points of the chimney (1) which it is to close, thus ensuring sealing even in the case of deformation of the key or of the pad (2). Furthermore, since the pad (2) is resiliently snap fitted, it may be replaced instantaneously.

10 Claims, 2 Drawing Figures

PAD FITTING DEVICE FOR A WIND MUSICAL INSTRUMENT KEY

Figure 1:
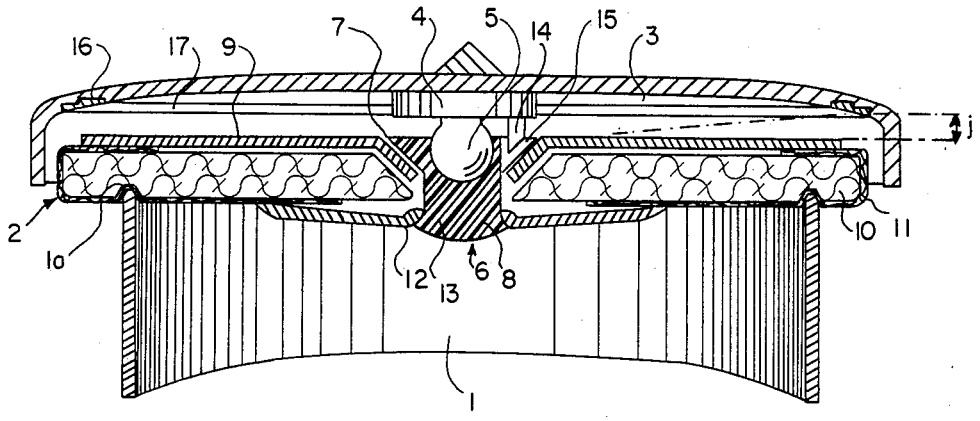

The present invention relates generally to wind musical instruments of the key type, such as saxophones, clarinettes, bassoons, flutes or similar, and relates more particularly to the fitting of the pads of the keys for these instruments.

Wind musical instruments of the above type include chimneys disposed along the body thereof, the pitch of a note emitted depending on a specific combination associating open and closed chimneys. The opening and closing of said chimneys are prrovided by pads housed in cups fixed to the ends of brass keys hinged to the body of the instrument. Each pad is formed of a felt washer mounted on a cardboard backing, both enveloped in a fine skin stretched by riveting at the center of the pad. For improved acoustic efficiency, the pads generally comprise rigid washers called resonators disposed on the visible face of said pads.

In traditional manufacture, the keys and the pads are fitted to the instrument, the pads being adjusted in a position providing good sealing on closure of the chimneys. This delicate adjustment is ordinarily carried out by successive deformations of the key until the pad is perfectly applied at all points to the edge of the corresponding chimney.

After inevitable wear, certain keys undergo a progressive deformation due to the forces permanently exerted thereon by the musician, whereas the pads begin to swell to a greater or lesser degree depending on the amount of humidity absorbed, the whole of the above deformations resulting in maladjustment of the slope of the pads and so in a sealing defect on closure of the chimneys. Because of the frequent, precise and fastidious nature of the adjustment of the inclined position of the pads, it is necessary to call on the services of a specialized technician, resulting in journeys for the musician causing a loss of time, immobilization of the instrument and high costs.

To get over these drawbacks, the U.S. Pat. No. 1,702,962 BUESCHER has provided a pad fitting device actuated by the key of a wind musical instrument so as to close a chimney of said instrument, said device including:

- a cup operationally connectable to said key,
- a pad made from a compressible material such as felt, fixed to a rigid backing,
- a rivet serving as central support for the pad, and
- a hinge with male and female components connecting the center of the pad to the center of the bottom of the cup, so that the pad may assume, through a universal angular free movement, any slanted position with respect to the cup.

This fitting device has never been applied in practice for the means proposed do not allow the desired aim to be reached and this for the following reasons:

(a) the design of the BUESCHER hinge is such, as is expressly mentioned in this patent, that the amplitude of the free angular movement of pad 6 can only be small, whatever the distance provided between the bottom of the cup 1 and the backing 8 of the pad 6, this being due among other things to the locking of the other end of socket 5 by the root of the convex head 3;

(b) when it is known that a chimney has a normally cutting outer edge, which leaves an imprint of complementary profile on the pad 6, and when the sealing must take place at the level of this imprint, it is imperative for the contact between the pad and the chimney to take place always strictly at the same position. Now, since a pad is in practice never perfectly centered with respect to the chimney which it controls and since, according to BUESCHER the pad rotates freely about the convex head 3, it is clear that the imprint is constantly shifted resulting in a sealing defect.

In addition, the hinge proposed by BUESCHER which involves a pivoting point of uncertain location and a diversity of friction zones, presents risks in so far as noise, tactile sensation or accidental snarling are concerned likely to impair the correct operation of the instrument.

Another attempt for automatically adjusting the pads is shown in the U.S. Pat. No. 3,205,752 CARRUTHERS which provides a device operating without any imprint formation in which the distribution of the compressible and rigid materials involved in stoppering the instrument is inverted, which adversely affects the acoustic behavior of the chambers formed by the chimneys once closed by their respective pads and consequently the very timbre of the instrument. This defect is further aggravated by the elastomer constitution of said compressible materials.

In addition, the CARRUTHERS system involves a modification of the instrument, itself.

The aim of the present invention is too overcome the drawbacks of the prior technique and, in particular, to provide a device for fitting pads in the cups:

(a) providing, without friction or flexion stress, permanent automatic adjustment of the slanted position of the pads, (b) ensuring maintenance of the correct position of the pad, (c) ensuring the maintenance of the chimney edge in correct correspondance with its imprint on the pad, (d) allowing the pad to be instantaneously changed by the user, and (e) readily adapted to an instrument, already existing.

These objectives are reached in that the device of the invention includes means provided for preventing relative rotation of the pad with respect to the cup.

Thus, the edge of the chimney always comes into contact at the same position with the pad and only a single imprint is formed therein.

In a first embodiment of the invention, said means provided for preventing rotation of the pad belong to the structure of the hinge formed of male and female components.

Generally, these means include a spur and a split, said spur penetrating into said slit and being partially locked therein, any one of these two means belonging to the structure of the male component of the hinge whereas the other belongs to the structure of the female component of said hinge.

In another embodiment, said means provided for preventing rotation of the pad with respect to the cup belong to the pad and to the cup.

Generally, these means include a stud and an opening, said stud penetrating into said opening and being partially locked therein, any one of these two means belonging to the pad whereas to other belongs to the cup.

Figure 2:
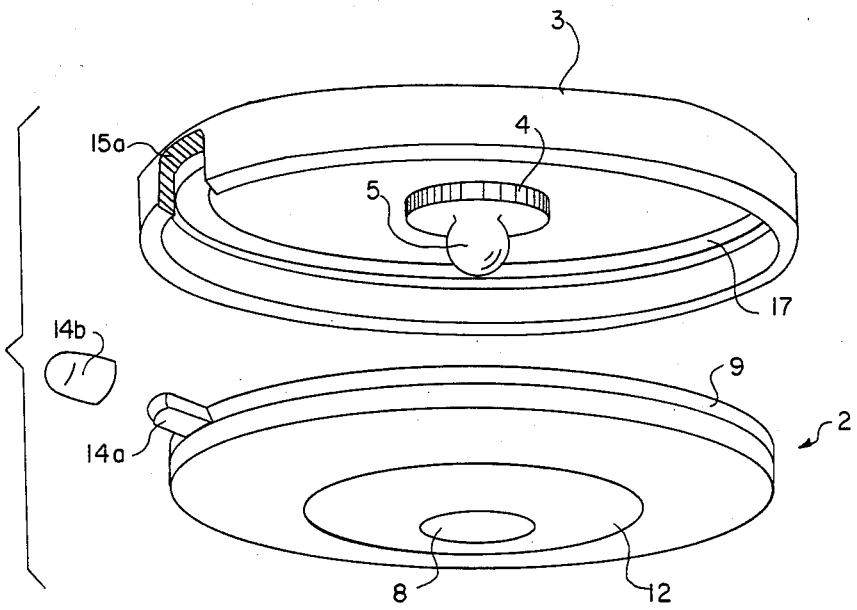

Other features and advantages of the invention will be clear from the following description given by way of non limitative example with reference to the accompanying drawings in which:

FIG. 1 is a cross sectional view showing the fitting of a pad of the invention into a cup of a saxophone key, the key itself not being shown for the sake of clarity, and FIG. 2 is a partially exploded perspective view of a device similar to that of FIG. 1, but showing another possibility of construction of the means for securing the pad against rotation.

Referring to FIG. 1 reference 1 designates a chimney of the instrument. This chimney is closed by a movable pad designated as a whole by the reference 2, fitted in a cup 3 itself fixed to an end of a key (not shown) hinged to the body of the instrument, and actuated by the musician so as to open and close the chimney 1.

In accordance with the invention, plate 4 having at its center a sphere 5 is welded to the center of the bottom of cup 3, so that said sphere 5 projects inwardly of cup 3. Preferably, the support-sphere assembly 4, 5 is formed as an integral piece on the lathe.

Sphere 5 is fitted resiliently into a housing in the form of a sphere portion formed in the flat head of a rivet 6 made from polyethylene or similar.

The head of rivet 6 has a peripheral truncated cone shaped surface 7 engaged in an opening of complementary shape formed in a flat circular metal backing plate 9 of small thickness, to the lower face of which is bonded a felt washer 10 covered, as is known per se, with a skin 11.

Pad 2, formed as a whole by the felt washer 10, skin 11 and backing plate 9, is held on the head of rivet 6 by means of the usual resonator 12 having a central opening engaged on the shank 8 of rivet 6, said shank 8 being cut flush with the resonator 12 and not melted so as to form a peripheral shoulder 13 for retaining the resonator 12 and pad 2 on the head of rivet 6.

The hinge comprising the sphere 5 and the head of rivet 6 is such that pad 2 may freely perform a universal angular movement without superfluous play with respect to cup 3, the distance j provided between the bottom of cup 3 and the backing plate 9 of pad 2 determining the maximum slanted position which pad 2 may assume with respect to the bottom of cup 3. This maximum slant is shown with a dot dasy line in the drawings.

According to one of the features of the invention, pad 2 is secured against rotation with respect to cup 3, about the hinge axis 5, 6 by a spur 14 fixed to the support plate 4, said spur 14 extending towards pad 2, parallel to the axis of cup 3 and in the vicinity thereof, and penetrates into a slit 15 provided for this purpose in the head of rivet 6. Said slit 15 is overdimensioned with respect to spur 14 so as not to hinder the angular movements of pad 2. It will be readily understood that securing pad 2 against rotation prevents any shifting, on these grounds, and the imprint 1*a* of the edge of chimney 1.

Optionally, so as to absorb a possible shock of the periphery of backing plate 9 on the bottom of cup 3, this latter may have in the vicinity of its periphery a circular groove 16 in which is housed an elastomer ring 17, this groove 16 being aligned with the periphery of backing plate 9.

In another embodiment illustrated in FIG. 2, pad 2 is secured against rotation by stud 14*a* integrally formed with the backing plate 9 of the pad and extending radially from the periphery thereof, said stud 14being capped with an elastomer muffler cap 14*b* so as to fit in the opening 15*a* formed in the peripheral skirt of cup 3. Said opening 15*a* is overdimensioned with respect to stud 14*a* capped with its cap 14*b*, so as not to hinver the angular mmovements of pad 2.

The advantages of this arrangement, with respect to the preceding embodiment, are that it is easily formed and the positioning and removal of pad 2 are visually and materially facilitated, with however as drawback a slight aesthetic modification of the instrument.

Whatever the embodiment chosen, it will be readily understood that:

(a) if the key, cup 3 and pad 2 undergo deformation following the normal wear of the instrument, pad 2 itself assumes and keeps the desired slanted position with respect to cup 3 so as to be freely and uniformly applied at all points to the edge of chimney 1, thus ensuring under all conditions sealed closure thereof, which sealing is further guaranteed by means 14, 15 or 14*a*, 15*a* for securing pad 2 against rotation;

(b) the mounting of hinge 5, 6 by resilient fitting together means that pad 2 can be instantly charged by the user himself;

(c) since pad 2 is identical to known devices (except for the backing plate) and since the principle of stoppering the chimneys remains unchanged with respect to the prior art, no impairment off the sound characteristics of the instrument, is to be feared;

(d) the aesthetics of the instrument, is not modified;

(e) the operation of the hinge with spherical components 5, 6 generates no specific tactile sensations;

(f) a small free movement between the spherical members 5, 6 of this hinge will guarantee complete absence of specific noise, without comprising the freedom of movement thereof;

(g) the very minor modification, from a material point of view, made to the conventional structure of the instruments will result in only a low investment for manufacturers or users.

I claim:

1. A device for fitting a pad actuated by the key of a wind musical instrument so as to close a chimney of said intrument, said device including:

a cup operationally connectable to said key, a pad, made from a compressable material such as flat, fixed to a rigid backing plate, a rivet serving as central support for the pad, and a hinge with male and female components connecting the center of the pad to the center of the bottom of the cup, so that the pad may assume, through a universal angular free movement, any slanted position with respect to the cup, characterized in that it includes means provided for preventing relative rotation of the pad with respect to the cup.

2. Device according to claim 1, characterized in that said means provided for preventing rotation of the pad belong to the structure of said hinge with male and female components.

3. Device according to claim 1, characterized in that said means provided for preventing rotation of the pad include a spur and a slit, said spur penetrating into said slit and being partially locked therein, any one of these means belonging to the structure of the male component of the hinge, whereas the other belongs to the structure of the female component of said hinge.

4. Device according to claim 1, characterized in that the pad is secured against rotation with respect to the cup, about the axis of the hinge by a spur fixed on a support plate, said spur extending in the direction of the pad, parallel to the axis of the cup and in the vicinity thereof, so as to penetrate into a slit provided for this purpose in the head of the rivet, said slit being overdimensioned with respect to the spur.

5. Device according to claim 1, characterized in that that means provided for preventing rotation of the pad belong to the pad and to the cup.

6. Device according to claim 1, characterized in that said means provided for preventing rotation of the pad include a stud and an opening, said stud penetrating into said opening and being partially locked therein, any one of these two means belonging to the pad, whereas the other belongs to the cup.

7. Device according to claim 1, characterized in that the pad is secured against rotation by a stud integrally formed with the backing plate of the pad and extending radially from the periphery thereof, said stud being capped with an elastomer muffler cap for fitting inside an opening formed in the peripheral skirt of the cup, said opening being overdimensioned with respect to the stud capped with its cap.

8. Device according to claim 1, characterized in that the male component of said hinge is a sphere.

9. Device according to claim 1, characterized in that the male component of said hinge is a sphere which is fitted resiliently into a complementary housing formed in the head of the rivet which is made from plastic material with a low friction coefficient.

10. Device according to claim 1, in which a distance is provided between the bottom of the cup and the backing plate of the pad, characterized in that this distance determines the minimum slanted position which the pad may assume with respect to the bottom of the cup.

* * * * *

UNITED STATES PATENT AND TRADEMARK OFFICE

CERTIFICATE OF CORRECTION

PATENT NO. : 4,729,275

DATED : March 8, 1988

INVENTOR(S) : Aime Elbaz

It is certified that error appears in the above-identified patent and that said Letters Patent is hereby corrected as shown below:

Column 2, line 28, delete "too" and insert --to--.

Column 3, line 32, delete "not" and insert --hot--.

Column 3, line 42, delete "dasy" and insert --dash--.

Column 3, line 53, delete "and" and insert --of--.

Column 3, line 63, delete "14being" and insert -- 14a being--.

Column 3, line 67, delete "hinver" and insert --hinder--.

Column 4, line 17, delete "charged" and insert --changed--.

Column 4, line 22, delete "off" and insert --of--.

Column 4, line 29, delete "comprising" and insert --compromising--.

UNITED STATES PATENT AND TRADEMARK OFFICE

CERTIFICATE OF CORRECTION

PATENT NO. : 4,729,275

DATED : March 8, 1988

INVENTOR(S) : Aime Elbaz

It is certified that error appears in the above-identified patent and that said Letters Patent is hereby corrected as shown below:

Column 4, line 41, delete "flat" and insert --felt--.

Column 6, line 13, delete "minimum" and insert --maximum--.

Signed and Sealed this

Twenty-third Day of August, 1988

*Attest:*

DONALD J. QUIGG

*Attesting Officer*

*Commissioner of Patents and Trademarks*